US005190678A

United States Patent [19]

Swartz et al.

[11] Patent Number: 5,190,678

[45] Date of Patent: Mar. 2, 1993

[54] PROCESS FOR THE PREPARATION OF OVER-BASED GROUP 2A METAL SULFONATE GREASES AND THICKENED COMPOSITIONS

[75] Inventors: Charles J. Swartz; Bryant J. Hardy, both of Ponca City, Okla.

[73] Assignee: Conoco Inc., Ponca City, Okla.

[21] Appl. No.: 609,324

[22] Filed: Nov. 2, 1990

[51] Int. Cl.[5] ..... C10M 115/10

[52] U.S. Cl. ..... 252/18; 252/33

[58] Field of Search ..... 252/18, 33

[56] References Cited

U.S. PATENT DOCUMENTS

| | | | |
|---|---|---|---|
| 2,920,105 | 1/1960 | Kluge et al. . | |
| 3,027,325 | 3/1962 | McMillen et al. . | |
| 3,057,896 | 10/1962 | Schicht et al. . | |
| 3,242,079 | 3/1966 | McMillen . | |
| 3,350,308 | 10/1967 | McMillen . | |
| 3,365,396 | 1/1968 | Schlicht . | |
| 3,372,115 | 3/1968 | McMillen | 252/33 |
| 3,376,222 | 4/1968 | McMillen . | |
| 3,384,586 | 5/1968 | McMillen | 252/33 |
| 3,565,672 | 2/1971 | Adams | 252/33 |
| 3,671,012 | 6/1972 | Scott et al. | 252/33 |
| 3,746,643 | 7/1973 | Rogers . | |
| 3,766,066 | 10/1973 | McMillen | 252/33 |
| 3,766,067 | 10/1973 | McMillen | 252/33 |
| 3,816,310 | 6/1974 | Hunt | 252/33 |
| 3,850,823 | 11/1974 | Kjonaas | 252/18 |
| 4,597,880 | 7/1986 | Eliades . | |

OTHER PUBLICATIONS

German Offen. 1,919,342 (Chem. Abstract, vol. 72(34096m 1970).

French 1,450,553 (Chem Abstract, 67678H 1967).

*Primary Examiner*—Jerry Johnson

[57] ABSTRACT

Group 2A metal greases having a dropping point in excess of 650° F. are produced by a manufacturing process in which water is carefully controlled in the process while conversion to grease is occurring. It is necessary to complete the reaction and dehydrate the reaction mixture before finish oils and additives are added in order to obtain a reproducible grease with a high drop point and a low penetration value.

6 Claims, No Drawings

PROCESS FOR THE PREPARATION OF OVER-BASED GROUP 2A METAL SULFONATE GREASES AND THICKENED COMPOSITIONS

BACKGROUND OF THE INVENTION

This invention is directed to an improved process for the preparation of over-based Group 2A metal sulfonate greases and thickened compositions. Greases and thickened compositions of the present invention are of the heretofore known thixotropic type which comprise a volatile and/or a nonvolatile liquid carrier of solvents such as mineral oil or mineral spirits or equivalent oil medium together with an oil soluble Group 2A metal sulfonate derived from oil soluble higher molecular weight sulfonic acids.

Thixotropic greases are thickened over-based Group 2A sulfonate compositions particularly calcium sulfonate compositions having corrosion inhibiting properties and having utility for a variety of uses such as automobile and truck body undercoatings, lubricants and various other purposes which are known in the art. Such greases are thickened compositions which have gone into quite widespread use either as lubricants or admixed with other ingredients to produce compositions for use in a variety of environments. Generally speaking, these materials are characterized by reasonably good anti-wear properties, reasonably good resistance to mechanical breakdown, salt spray and water corrosion, together with thermal stability at high temperatures.

These greases are normally prepared in either a one step or a two step process. In the two step process, there is initially prepared a Newtonian solution by admixing a normally liquid oil, commonly a mineral oil or a mineral oil and a non-mineral oil volatile organic solvent such as hexene, with a normally liquid sulfonic acid comprising or containing an aliphatic straight or branch chain having at least 12 carbon atoms and having a molecular weight of from about 300 to about 700. These materials are then added to a Group of 2A metal oxide or metal hydroxide (such as calcium oxide or calcium hydroxide) which together with a promoter serves to produce an over-based Group 2A metal sulfonate which commonly has a large degree of overbasing. The resultant mixture is a Newtonian solution containing the over-based metal sulfonate dissolved or dispersed in the mineral oil, which solution is filtered to form a clear solution. The resulting clear Newtonian solution is then subjected to treatment in a second step which involves generally vigorous mixing and heating in the presence of a converting agent which may be water or water soluble alcohols or glycol ethers such as methyl cellosolve (mono-methyl ether of ethylene glycol) or mixtures, of water and such alcohols, or water soluble acids such as acetic acid or propionic acid. The second step results in converting the Newtonian solution to a non-Newtonian dispersed system in the form of a grease or a thickened composition.

The prior art one step process of forming the greases or thickened compositions differs from the two step process in that essentially all of the ingredients are mixed and there is no separately formed or separately formed and recovered Newtonian solution of an over-based metal sulfonate dissolved or dispersed in mineral oil. From an economic viewpoint, the one step process has a definite advantage over the two step process.

However, in carrying out either of these processes, it becomes apparent that grease reproducibility and ability to meet certain specifications has been erratic at best. Commercial products suffer long periods of time when top quality grease is not produced, but rather a more inferior grease is produced, which while suitable for many or even most applications, it not suitable for certain high demand applications.

Consequently, it would be desirable to determine a method for making a consistently high quality grease, having a dropping point in excess of 650° F. It is further desirable that these greases have a penetration values consistent with National Lubricating Grease Institute (NLGI) grades for most such purposes.

It is therefore an object of the present invention to provide a method for the preparation of an over-based metal sulfonate grease having a dropping point of at least 650° F. Other objects will become apparent to those skilled in this art as the description proceeds.

THE PRESENT INVENTION

The present invention has resulted in effectively improving prior defects in known manufacturing practices for producing over-based metal sulfonate greases by the use of either the one step or two step processes. We have discovered that in carrying out the improved process of the present invention, a particular sequence of steps wherein reaction is carried out at a particular temperature for a time sufficient to reduce the half scale penetration to a value below 45 mm, and thereafter then raising the reactor contents to a higher temperature and dehydrating the reaction mass prior to finishing the grease, results in a consistently reproducible, high dropping point over-based metal sulfonate grease.

We have now discovered a method for the production of over-based metal sulfonate thickened grease with a dropping point of at least 650° F. comprising:

(a) mixing base oil, thickener, catalyst and water-containing ingredients in a reaction vessel;

(b) reacting the mixture at a temperature below about 210° F. for a time sufficient to reduce the half scale penetration to a value below 45 mm while venting the vessel to prevent condensation of water within the vessel;

(c) raising the reactor contents to at least 260° F., preferably to at least 300° F. with constant stirring, and dehydrating the reaction mass by removing the catalyst and water without allowing either to condense and reenter the vessel; then (d) adding finish oil as necessary to meet penetration and composition targets.

As will be apparent to those skilled in the art, various grease additives such as anti-wear additives and anti-oxidant additives, extreme pressure additives and anti-rust additives can be added to finish grease compositions to necessary specifications. In the present invention, such additives are added with thorough blending after the dehydration step and before the addition of finish oil. These additives and their use do not constitute a portion of the present invention, since use and quantity of each additive is determined by process specifications and intended end use.

In the practice of the present invention use is made of a base oil which may be a light or volatile hydrocarbon or a nonvolatile oil such as a mineral oil or mixtures of these, together with Group 2A over-based metal sulfonate (of which calcium sulfonate is preferred) and which is incorporated into the other ingredients together with an alcohol or an alkoxyalkanol which may be one or more of the various available substituted or unsubstituted alcohols containing from 1 to 8 carbon atoms. The preferred alcohol is methanol and the preferred alkoxyalkanol is methyl cellosolve. Water is generally introduced during the reaction to provide additional impetus to the catalysis. However, this water is detrimental if left over long in the reaction and must be removed together with unreacted catalyst.

The present invention produces an extremely high grade of grease, which can be compared to existing grades of grease according to the following definitions.

The grease of the present invention is a desired product or A grade grease. This grease meets National Lubricating Grease Institute (NLGI) No. 2 penetration grade of 45 weight percent over-based metal sulfonate (ASTM D-217) and has a dropping point of 650° or higher (ASTM D-2265).

The formerly standard specification grease is now a second, or B grade grease, meeting penetration grades with approximately 55 percent over-based metal sulfonate. On the average this grease has a dropping point of 470° F. with about one-third of the batches having a dropping point of 490° F. We have discovered that this previously specified grease is actually the degradation product of the preferred, high grade, or A grade grease which is caused by overprocessing and water presence.

The lowest grade is the former off-spec grease, or C grade grease, which usually results from additive poisoning. This grease cannot be constituted as an additive containing grease, since the additives usually combine with the grease in a poisoning effect to form the off-spec material. This grease has a very soft penetration. This grease can be easily formed by processing in a dirty kettle, which results in yield losses proportional to the residual grease.

The present invention resides in part in the discovery that the off grade greases B and C are degradation products from the A grade grease of the present invention, resulting from subsequent processing steps. Grease B, the former specification grade, results from poisoning the A grade grease of the present invention by contacting base grease A before additive addition with a water/catalyst combination (such as water/methyl cellosolve) at temperatures above the water/methyl cellosolve azeotropic boiling point. Grease C results from poisoning grease A by contacting with an additive package in the presence of the water/methyl cellosolve mixture. The present invention avoids these degradation processes by removing the water and methyl cellosolve catalyst before carrying out the finishing steps. The key steps are (1) to avoid reintroducing water to the batch after the water/methyl cellosolve azeotrope has been vented or removed during processing; (2) limiting the catalyst concentration and avoiding prolonged contact with the catalyst; and (3) removal of alcohol or alkoxyalcohol before introduction of additives.

The present invention is more concretely described with reference to the examples below wherein all parts and percentages are by weight unless otherwise specified. The examples are provided to illustrate the present invention and not to limited it.

In the examples carried out, penetration was measured according to ASTM D-217. Dropping point was measured according to ASTM D-2265. The following examples were carried out utilizing the following test recipe.

TEST RECIPE

| COMPONENT | WT % |
|---|---|
| Overbased Calcium Sulfonate Thickener | 45-60 |
| Methyl Cellosolve | 2-4 |
| Water | 4-7 |
| Base Oil | 14-20 |
| Sodium Nitrite ($NaNO_2$)* | .3-.5 |
| Finish Oil | 15-40 |
| Substituted Diphenylamine | 1.4-1.8 |
| Diphenyldodecyl Succinic Acid | 1.8-2.8 |
| Zinc Naphthenate | .3-.5 |

*40% SOLN OF $NaNO_2$ IN WATER NOT INC IN MATERIAL BALANCE

EXAMPLE 1

Three separate procedure were carried out.

Procedure 1. The over-based sulfonate, base oil, methyl cellosolve, water and sodium nitrite solution were charged to a covered reaction vessel with thorough agitation. The vessel was brought to a temperature in the range of 180° to 190° F. and carefully maintained below 195° F. The kettle was sampled every 15 minutes and half scale penetration values according to ASTM D-217 were measured. Immediately after penetration declined to below 45 mm, the kettle lid was removed and the kettle was brought as rapidly as possible to 340° F. and held for 2 hours. It was observed that vapor continuously exited the top of the kettle.

After 2 hours at 340° F., diphenyldodecyl succinic acid, zinc napthanate and substituted diphenylamine were added to the kettle and mixed thoroughly. At the conclusion of the mixing, finish oil was charged as necessary for property specification to a penetration level of about 220. When recovered, the finished grease had a dropping point in excess of 650° F. as measured by ASTM D-2265.

EXAMPLE 2

The procedure described in Example 1 was repeated, except that water and methyl cellosolve were not allowed to exit the vessel and the reaction was carried out at a temperature of about 340° F. Penetration values were not measured. The reaction was carried out for a time of between 1 and 2 hours.

The remaining additive ingredients were then inserted as a batch and thoroughly mixed into the kettle. The resulting grease had a dropping point of 470° F. according to ASTM D-2265 and a penetration of about 260 according to ASTM D-217.

EXAMPLE 3

The recipe given for Example 1 was followed except that all ingredients were inserted into the kettle simultaneously and the kettle was raised to about 300° F. while being covered. The grease was cooked for approximately two to two and one-half hours and then removed and tested. Although the grease had a high dropping point by ASTM D-2265, the penetration values were very high according to ASTM D-217. The grease did not perform well.

A summary of the properties obtained during the three experiments are set for in Table 1.

TABLE 1

| GREASE | WITH ADDITIVES PENETRATION 0.1 mm | WITH ADDITIVES DROP POINT °F. | ADDITIVE FREE PENETRATION 0.1 mm | ADDITIVE FREE DROP POINT °F. |
|---|---|---|---|---|
| "A" | 220** | 650+ | 260 | 650+ |
| "B" | 260** | 470*** | 290 | 650+ |
| "C" | 310 | 650+ | * | * |

Penetration ASTM D-217
Dropping Point ASTM D-2265
*No additive free Grease "C"
**Std Dev = 10
***Std Dev = 40° F.

Thus, the contrast between the same recipe carried out under three different sets of conditions is apparent. The process of the present invention, using 1) a low temperature reaction between the catalyst, over-based calcium sulfonate and base oil, followed 2) by a rapid rise in temperature and removal of water and water catalyst azeotrope, then 3), adding additives and the finish oil to meet the specification, resulted in extremely high quality grease. Failure to remove the water from the kettle clearly shows that water poisons the reaction and causes an inferior material. It is likewise true that the additives added in the presence of water and catalyst as shown in Example 3 can poison the reaction and form a markedly inferior grease.

Those skilled in this art will recognize that the test recipe given can be varied substantially. For example, reducing the catalyst to over-based metal sulfonate ratio will result in a slower reaction time, but otherwise will not inhibit the quality of the grease produced. In contrast, leaving the catalyst in contact with the grease together with water during the time of high temperature heating over reacts (or over processes) the grease and results in a diminution of properties. Thus, it is critical to remove excess catalyst from the grease together with water as measured by half scale penetration before continuing and finishing the grease.

Direct comparison of processes 1 and 2 show the effect of leaving the catalyst in the grease too long, leading to an overcooking or overreaction of the grease. Process 3 is the worst possible case of poisoning the grease batch in that conversion continues, utilizing the additives as well as the oils and thickeners, and produces a markedly inferior grease. However, the presence of the additive package does not appear to cause the conversion from A grease to C grease, but only accelerates this reaction. A comparison of Examples 1 and 2 show that the absence of a dehydration step with a reintroduction by condensation of more water at 220° F. or more, presents the same circumstances and could be the sole reason for converting the top grade grease to a second grade grease. In Table 1, it should be noted that there is technically no such thing as an additive-free C grade grease since C grade grease results from additive poisoning of A grade grease.

The removal of water in the present invention is easily accomplished by simply preparing the grease in an open kettle, since the catalyst and water form low boiling azeotropes at between 200° and 210° F. This azeotrope composition is about 20 percent methyl cellosolve and 80 percent water is the examples given. When the ratio of methyl cellosolve catalyst to water is about 1 to 2, nearly 50 percent of the catalyst is removed at 210° F. instead of at the normal boiling point of 256° F. for methyl cellosolve.

The catalyst and water can be recovered and reused, since they are not affected by removal from the process.

Thus, the present invention provides an improved method for reproducibly obtaining a high quality grease having a high dropping point. Target penetration values are achieved by using finishing oil as necessary to meet the penetration specification.

While certain embodiments and details have been shown for the purpose of illustrating the present invention, it will be apparent to those skilled in the art that various changes and modifications may be made herein without departing from the spirit or scope of the invention.

We claim:

1. A method for the production of overbased metal sulfonate thickened grease with a dropping point of at least 650° F. comprising:
   (a) mixing base oil, thickener, catalyst and water containing ingredients in a reaction vessel;
   (b) reacting the mixture at a temperature below 210° F. for a time sufficient to reduce the half-scale penetration to a value below 45 mm while venting the vessel to prevent condensation of water within the vessel;
   (c) raising the reactor contents to at least 260° F. with constant stirring and dehydrating the reaction mass by removing the catalyst and water without allowing either to condense and re-enter the vessel; then
   (d) adding finish oil as necessary to meet penetration and composition targets.

2. A method as described in claim 1 wherein grease additives are added with thorough blending after dehydration and before addition of finish oil.

3. A method as described in claim 1 wherein the grease prepared is formed using Group 2A metal sulfonate.

4. A method as described in claim 2 wherein the grease is formed from calcium sulfonate.

5. A method as described in claim 3 wherein the catalyst is methyl cellosolve in water containing sodium nitrite.

6. A method as described in claim 5 wherein:
   (a) overbased calcium sulfonate, base oil, methyl cellosolve catalyst and water containing sodium nitrite are thoroughly mixed at a temperature of up to 195° F.;
   (b) the reaction product of (a) is reacted until a half scale penetration value below 45 mm is achieved while venting the vessel to prevent condensation of water within the vessel; then
   (c) raising the temperature of the reaction product of (b) to a temperature of at least 300° F. and dehydrating by removing water and water azeotropes, then adding anti-oxidants, anti-wear, extreme pressure and anti-rust additives as per specification to the reactor mass during thorough mixing; and
   (d) adding finish oil to the reactor mass to achieve the target penetration value.

* * * * *